US006168513B1

(12) United States Patent
Souza et al.

(10) Patent No.: US 6,168,513 B1
(45) Date of Patent: Jan. 2, 2001

(54) APPARATUS AND METHOD FOR GAMING DEVICE COIN PAYOUT

(75) Inventors: Michael Joseph Souza, Sparks; Binh Nguyen, Reno; Leagh Beadell, Sparks, all of NV (US)

(73) Assignee: International Game Technology, Reno, NV (US)

( * ) Notice: Under 35 U.S.C. 154(b), the term of this patent shall be extended for 0 days.

(21) Appl. No.: 09/263,644

(22) Filed: Mar. 5, 1999

(51) Int. Cl.[7] ..... G07D 1/00
(52) U.S. Cl. ..... 453/57
(58) Field of Search ..... 453/30, 32, 33, 453/49, 57; 221/203, 237

(56) References Cited

U.S. PATENT DOCUMENTS 5,098,339 * 3/1992 Dabrowski ..... 453/57 X
5,316,517 * 5/1994 Chiba et al. ..... 453/57
5,711,704 * 1/1998 Hughes et al. ..... 453/57

* cited by examiner

*Primary Examiner*—F. J. Bartuska
(74) *Attorney, Agent, or Firm*—Sheridan Ross P.C.

(57) ABSTRACT

A coin singulator for outputting coins in single file in a known orientation for effecting payout from a gaming terminal is provided. A rotatable disk is positioned spaced-apart from a backplate to define a substantially cylindrical region therebetween in conjunction with a rim region. Vanes on the front surface of the rotating disk convey coins picked up from a randomly-oriented mass of coins to a central opening of the disk for conveyance through the central opening into the space between the disk and the backplate. The distance between the disk and the backplate is such that only a single layer or thickness of coins is accommodated. Preferably the backplate is inclined such that the coins are positioned in face-to-face contact with the backplate. A plurality of vanes on the back surface of the disk moves the coin along the rim to an exit opening in the rim with the back surface vanes preferably shaped to output no more than a single coin as each rim passes the opening. The device can accommodate a range of coin or token sizes thus reducing the number of configurations or parts to be kept in inventory.

20 Claims, 4 Drawing Sheets

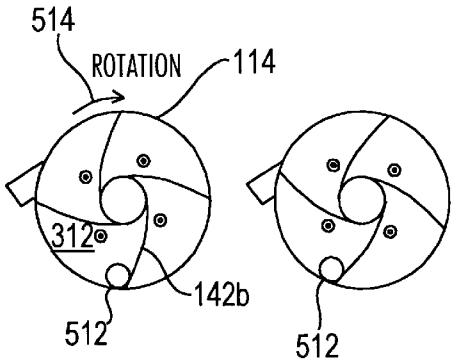
FIG. 5A
FIG. 5B
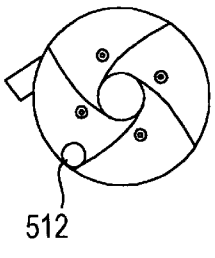
FIG. 5C
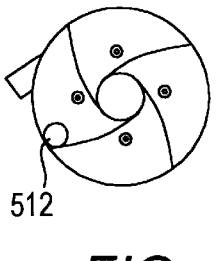
FIG. 5D
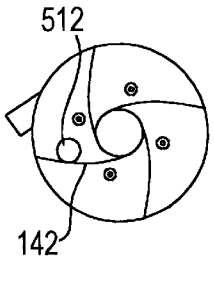
FIG. 5E
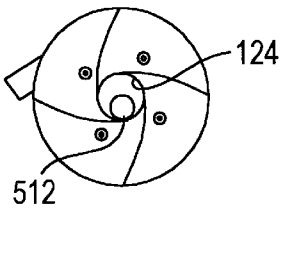
FIG. 5F
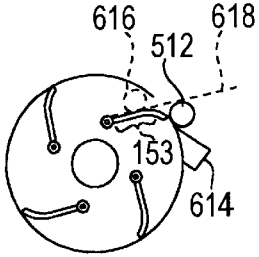
FIG. 6A
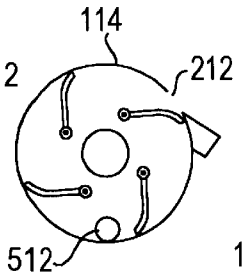
FIG. 6B
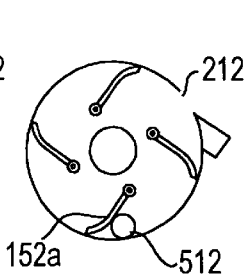
FIG. 6C
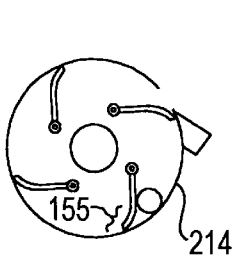
FIG. 6D
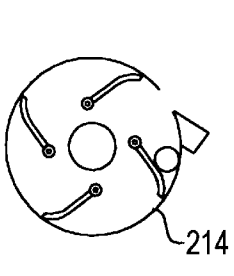
FIG. 6E
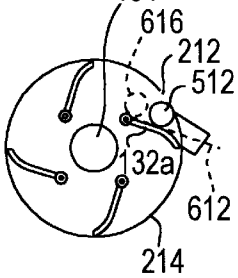
FIG. 6F
FIG. 6G

APPARATUS AND METHOD FOR GAMING DEVICE COIN PAYOUT

FIELD OF THE INVENTION

The present invention relates to an apparatus and method for singulating coins for payout from a gaming device and in particular to an apparatus with a rotatable disk for conveying coins of various sizes to an exit opening.

BACKGROUND INFORMATION

A number of gaming devices include an apparatus for dispensing or paying out coins, tokens and the like e.g. in response to a win on the gaming device. For example, in response to a win on a slot machine, poker machine, keno machine, blackjack machine and the like, some such machines dispense a plurality of coins, depending on the type of win. Often, some or all of the dispensed coins are coins which have been inserted (as wagers) into the gaming device and in one typical configuration, such previously-inserted coins are held in a hopper region in a random orientation. However, the mechanism for dispensing the payout coins typically is configured to operate with coins which have been singulated, i.e. which are provided in single file in a known orientation. In addition to assisting in operation of the payout transport mechanics, singulation is also useful in connection with counting or detecting the coins as they are paid out (to assure that the correct number of coins are paid out). For this reason, it is useful to provide a mechanism which receives the randomly-oriented or heaped coins and outputs the coins in a controlled, singulated fashion with the coins in a known orientation.

A number of devices have been provided for assisting in such singulation for gaming devices, or other coin handling including those described in U.S. patent application Ser. No. 08/846,796 for "MULTI-DENOMINATIONAL COIN OUTPUT HOPPER" filed Apr. 30, 1997, and U.S. patent application Ser. No. 08/969,605 filed Nov. 13, 1997 now U.S. Pat. No. 600,365 for "OUTPUT SENSING FOR A GAMING DEVICE", both incorporated herein by reference, and U.S. Pat. No. 5,167,571.

In a typical gaming device, only a single denomination or size of coin is used. However, there are a large number of possible coin denominations, including coins of a relatively large number of different countries, as well as casino-minted coins or "tokens", which can come in a wide variety of sizes (diameters and thicknesses).

Many previous coin output singulators were configured to accommodate only one (or only a few) coin sizes. As a result, it has been necessary to design and construct a relatively large number of different configurations of coin singulators, e.g. a different coin singulator for each differently-sized coin or token. The result has been that many manufacturers of gaming devices have been required to design and to keep in inventory hundreds or thousands of different coin output singulators for accommodating various coin denominations or tokens. Even when a coin singulator in previous approaches could accommodate more than one size of coin, previously the sizes that were thus accommodated had a relatively small range so that the total number of different devices required was still disadvantageously large. Maintaining such a large inventory has a number of associated disadvantages such as the need to maintain a sufficient number of trained personnel, repair and replacement parts and/or tools that all of the wide variety of coin singulators can be maintained and repaired. To make matters worse, it is not uncommon for casinos or similar gaming establishments to design new coins or tokens at a relatively high frequency, thus requiring a relatively large investment in time and effort for designing new singulators to accommodate such new coins or tokens.

Accordingly, it would be useful to provide a gaming device coin/token payout singulator which can accommodate a relatively wide range of coin sizes (diameters and/or thicknesses), preferably such that substantially all government-minted and casino-minted coins and tokens used throughout the world can be accommodated with a relatively small number (such as 3 or 4, or preferably, only 1) type or style of gaming device output singulator. Preferably such a small number of singulators would be capable of accommodating most or all new coin or token designs with little or no modification.

In many previous configurations, singulation of coins or tokens required handling or contact of the coins with a relatively large number of different singulator components and, accordingly, a new or different size of coin required redesigning a relatively large number of singulation components. Accordingly, it would be useful to provide a coin/token output singulator for a gaming device in which a design change, for accommodating a different size or size range of coins/tokens involved redesigning only a relatively small number, preferably only one or two, parts.

Previous coin output singulators have been subject to a relatively high frequency of jamming or other malfunctions. Such jamming can lead to dissatisfaction by gaming device players who may have difficulty in receiving the allotted prizes and by casino or other gaming device operators who may lose gaming terminal availability and/or may need to perform repair or service procedures as a result of such jamming or malfunctions. Accordingly, it would be useful to provide a gaming device coin/token output singulator which can substantially reduce or eliminate the incidence of jamming or other malfunctions.

In some gaming device configurations, output coins, even after they have been singulated, must be conveyed vertically or laterally to a payout tray or other output location. Many previous singulators were configured so that the direction or speed of output coins at the singulation output location was not particularly suited to the configuration or location of such coin "escalator" or other conveyor. Moreover, different styles or types of gaming devices may be configured with such escalators or other conveyors in different locations (with respect to the singulator). Accordingly, it would be useful to provide a gaming device coin/token output singulator which can be adjusted or operated so that the direction or velocity of the output coins may have any of a number of different directions or velocities e.g. to accommodate different positions or configurations of gaming terminal escalators, conveyors or other components.

SUMMARY OF THE INVENTION

The present invention provides a device and method which receives or contacts a randomly-oriented plurality of coins or tokens and uses a relatively easily implemented mechanism which can accommodate a wide variety of coin or token sizes while reducing or eliminating the incidence of jamming or other malfunctions. Although the apparatus of the present invention is preferably configured to accommodate a range of different coin sizes, it is anticipated that in a typical gaming device, only a single coin denomination will be used, i.e. there will typically not be a mixture of different coin sizes in the singulator at any given time.

In one embodiment, a rotatable disk is mounted parallel to and spaced from a backplate to define a space therebetween which can accommodate a single layer or thickness of a coin denomination or range of coin sizes. Preferably the thickness of the space between the disk and the plate can be readily adjusted, such as by inserting or removing spacers, to readily accommodate a number of different thickness ranges of coins or tokens. As the disk is rotated, a plurality of vanes adjacent, and preferably integrally formed with, the outer surface of the disk, operate to convey coins toward a central opening of the disk. The central opening forms a passageway to the space between the backplate and the disk, and is large enough to accommodate the largest anticipated coin diameter. Coins which are thus-conveyed through the central opening move into the space behind the disk, where a second plurality of vanes, preferably integrally formed on the back surface of the disk, operate to urge the coins circumferentially outward and toward a coin exit opening. Preferably the vanes on the front surface of a disk are spirally shaped to assist in conveying coins toward the central opening and have a configuration, near the central opening, so as to impart the desired range of radial velocity to coins as they approach the central opening. Preferably the vanes on the rear surface of the disk are configured to impart a radially-outward velocity to coins as they reach the exit opening and to avoid outputting more than one coin from any given vane as that vane passes the exit opening. The exit opening 212 (FIG. 2) has sufficient size to accommodate the diameter and thickness of the largest anticipated coin. The exit opening can be positioned at many locations along the circumference of the disk-plate space and the apparatus can be readily configured in a mirror image fashion so as to operate in either a clockwise or counterclockwise direction of rotation to assist in providing the exiting singulated coins with the desired direction and speed of exit at the desired circumferential location. Preferably, a given disk configuration (particularly the central opening size and the vane configurations) can accommodate a wide range of coin sizes (particularly coin diameters) and, in one embodiment, no more than three different disks are needed to accommodate substantially all coin diameters between about 0.7 inches and about 2 inches. Preferably the size, shape and exit location are provided in a fashion to be compatible with existing gaming terminals so that existing gaming terminals can be readily retrofit with an output singulator as described herein.

BRIEF DESCRIPTION OF THE DRAWINGS

FIGS. 5A–5F are front views of a disk and a coin showing successive positions as a coin is conveyed toward a central opening according to an embodiment of the present invention;

FIGS. 6A–6G are rear elevational views of a disk and a coin as the coin is conveyed toward an exit opening, showing successive positions.

DETAILED DESCRIPTION OF THE PREFERRED EMBODIMENT

Figure 1:
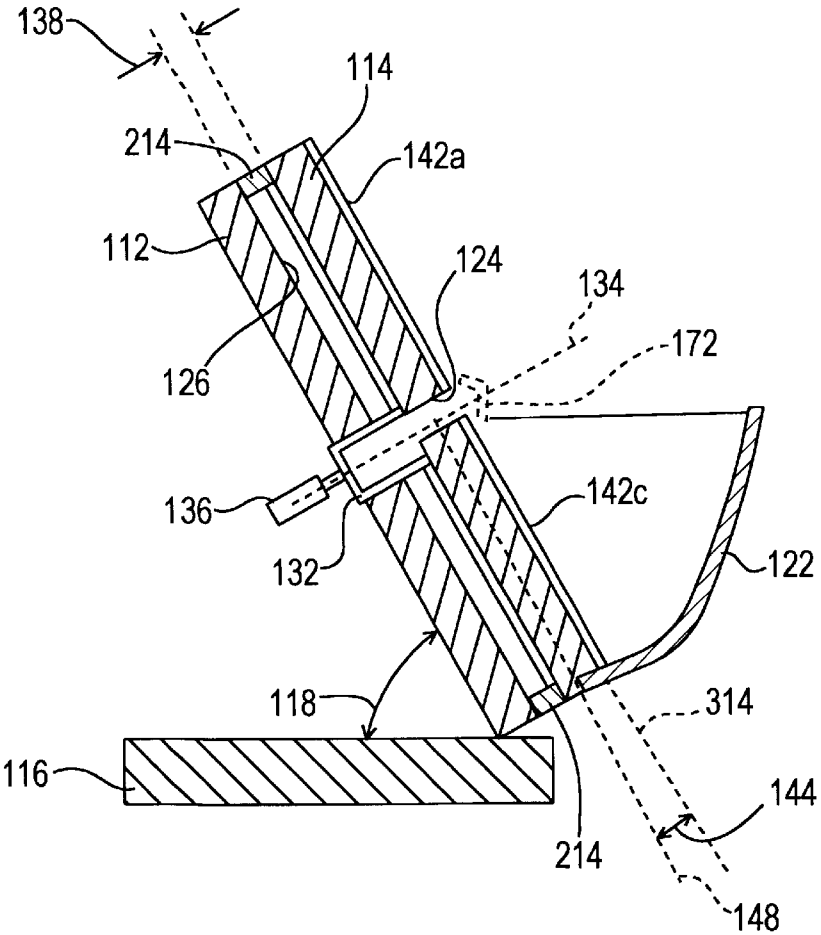
FIG. 1 is a side cross sectional view of a coin output hopper or singulator for a gaming device according to an embodiment of the present invention.

In the embodiment depicted in FIG. 1, a backplate 112 and a substantially parallel disk 114 are mounted e.g. on a base 116 such that the backplate 112 is positioned at an angle 118 to vertical. In one embodiment, the angle 118 is such as the position the back plate 112 about 30° away from vertical. The general operation of the device of FIG. 1 is to convey coins which reside, in random orientation, in a bowl 122, through a central opening 124 in the disk into the space 126 between the backplate 112 and disk 114 where coins are conveyed to an exit opening 212 (FIG. 2) formed in a side wall 214 to exit in a singulated fashion (as described more thoroughly below).

The disk 114 is mounted with respect to the backplate 112 by a hub 132 so as to be rotatable about a rotation axis 134 e.g. upon being driven by a motor 136. The weight or mass of the coins in the bowl 122 can be accommodated by assuring that the motor 136 delivers sufficient power to maintain the desired rotation rate while lifting (elevating) a coin to the elevation of the exit opening.

The distance 138 between the backplate 112 and the disk 114 is sufficient to accommodate the thickness of a coin and preferably small enough so as to avoid overlapping, shingling or other interaction between coins of a type which could lead to wedging or jamming, such as by being less than about twice the thickness of the thinnest coin to be accommodated. In one embodiment, the thickness 138 can be adjusted by providing for different sizes (lengths) of hub 132 and/or by adding washer-like spacers 140 between the hub 132 and the disk 114.

Figure 3:
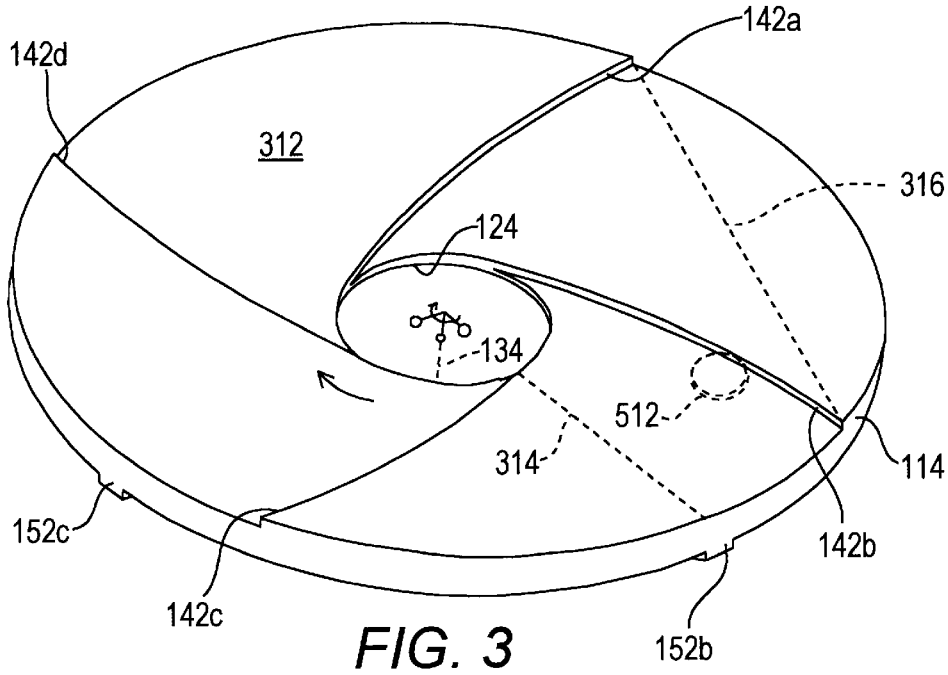
FIG. 3 is a front perspective view of a disk usable in connection with the present invention.
Figure 4:
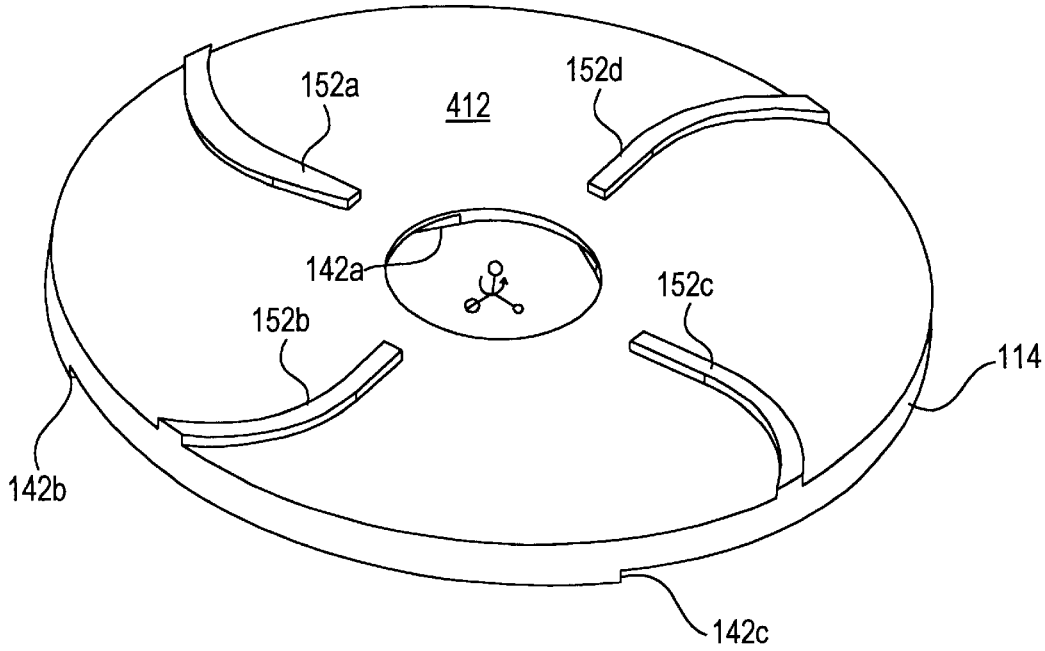
FIG. 4 is a rear perspective view of a disk usable in connection with the present invention.
Figure 7:
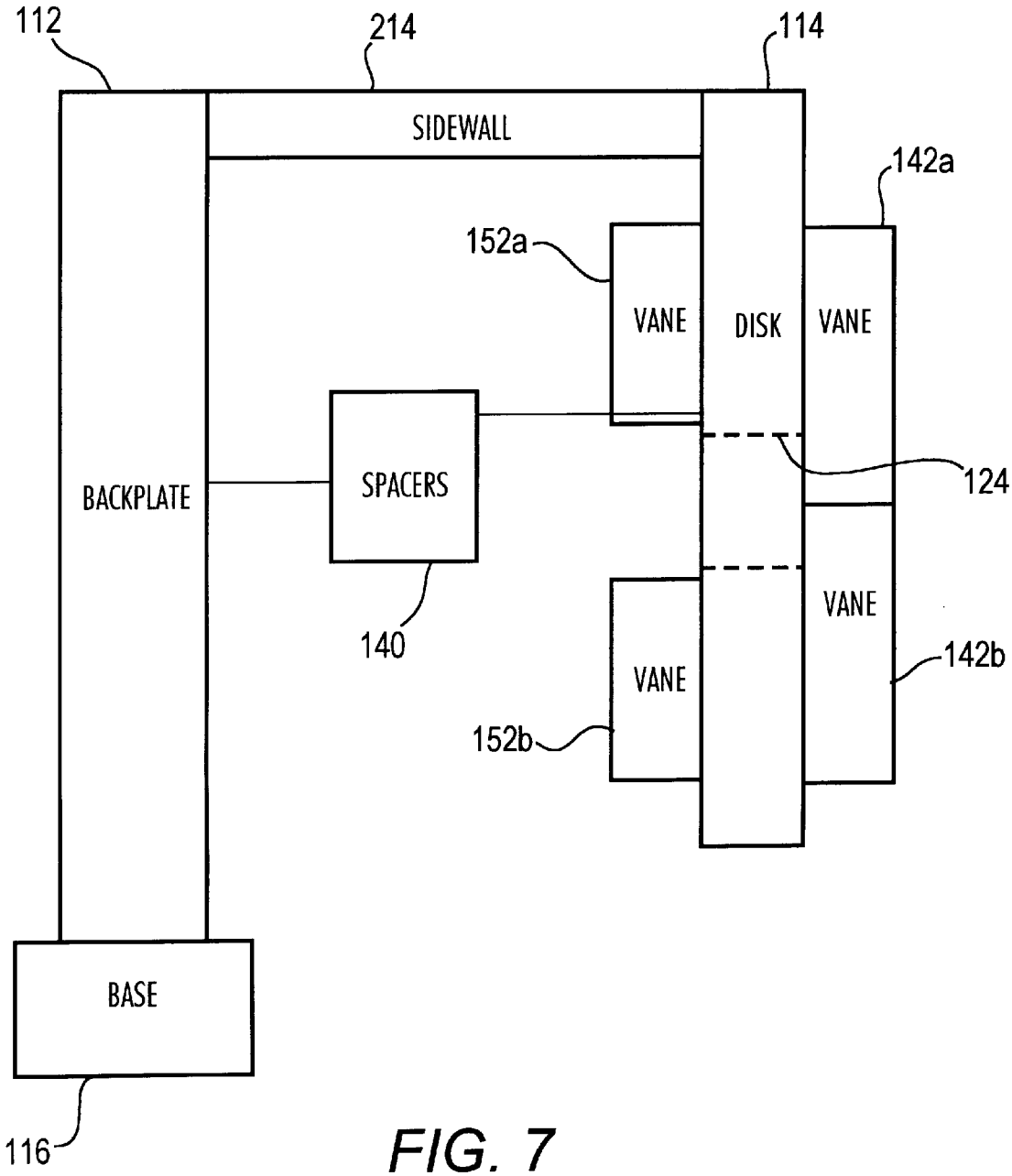
FIG. 7 is a representative block diagram of a singulator for a gaming device according to an embodiment of the present invention.

A plurality of vanes or ledges 142*a,b,c,d* are provided on the outer or front surface 312 of the disk 114, as best seen in FIG. 3. The ledges 142 are configured such that at least some of the coins in the hopper 122 will have their edges engaged by the vanes 142 for conveyance toward the central opening 124 by rotation of the disk 114 about the axis 134. In the depicted embodiment, the outer or front surface of the disk 312 is preferably provided with a tapering or generally conical configuration such that, for at least some and preferably for any, radius 314 along the outer surface 312, such radius 314 will be at an angle 144 with respect to a line 148 which is perpendicular to the rotation axis 134 as depicted in FIG. 1. Preferably, the regions of the front surface 312 which lie between the ledges or vanes 142 are substantially smooth or continuous e.g. such that a chord 316 which extends between two ledges or vanes 142 will have a substantially smooth profile. It is believed the angle 144 or tapering of the front surface assists in conveying coins toward the central opening 124. It is believed the substantially smooth nature of the surfaces between vanes 142 assists in avoiding stacking or shingling of coins, permitting coins which are not engaged by a vane 142 to slide over the surface of the disk e.g. for engagement by a subsequent vane of the disk. As best seen in FIG. 4, the rear surface of the disk 114 also includes a plurality of vanes 152*a,b,c,d.* Preferably, the regions of the back surface 412 between the vanes 152 are substantially planar and parallel to the front surface of the back plate 112 e.g. so that there is little or no opportunity for coins in the space 126 to overlap one another.

Although it is possible to provide the disk 114 and vanes or ledges 142, 152 from a plurality of components, preferably the disk 114 and all vanes 142, 152 are formed as a single integral piece e.g. such as by molding or by machining a disk blank. The disk 114 could be made from a number of materials such as plastic, metals such as steel, aluminum, titanium and the like, resins such as fiber-reinforced resins, and the like. FIGS. 5A–5F depict successive positions of the disk and a single coin as the disk rotates. Although only a single coin is depicted, typically a plurality of coins will be engaged by the vanes at any one time and there may be more than one coin on any one vane. Preferably, as the disk 114 rotates, the coins in the bowl 122 are agitated e.g. by contact with the vanes. Agitation may be enhanced, if desired, by configuring or mounting protrusions on the front surface of the disk 114. Owing partly to such agitation, and partly to the backward inclination 118 of the disk, a coin 512 will be engaged by a vane 142*b* as the disk 114 rotates (e.g. rotates in a clockwise direction 514, in the view of FIG. 5A). The coin 512 which is thus engaged will lie substantially flat, i.e. in face-to-face contact with respect to the outer surface 312 of the disk 114 and, as the disk rotates, the vane 142*b* will carry the coin 512 to successively more clockwise positions as depicted in FIGS. 5B, 5C and 5D. Owing partly to the effects of gravity and partly to centrifugal effects, the coin 512 will remain substantially adjacent to the outer circumference of the disk 114 during a first portion of rotation. As the disk further rotates clockwise, e.g. to the position depicted in FIG. 5E, the component of gravity which acts in a radially-outward direction with respect to the disk, diminishes, and, eventually, as the disk approaches the position depicted in FIG. 5E, the force of gravity imparts a radially inward force component on the coin 512, sufficient to overcome any centrifugal component, at least in part because the vane 142*b* has curved or spiral shape so that with the disk in this position gravity urges the coin "downhill" along the vane 142*b* which, as seen in FIG. 5E, provides a radially inward motion. The magnitude of the gravitational component useful for these purposes can be varied, to some extent, by adjusting the angle 118 of inclination. Further radially-inward motion of the coins 512 continues as the disk 114 continues its clockwise rotation, until the coin 512 is moved radially inward to the position of the central opening 124 as depicted in FIG. 5F. When the coin 512 reaches the central opening 124, the backward inclination 118 of the disk results in the coin passing through the central opening 124 and at least partially entering the space 126 between the disk 114 and the backplate 112.

The illustrations of FIGS. 5A–5F show the manner in which the spiral or curved nature of the vanes 142 assist in exploiting gravitational forces to move the coin 512 to the central opening 124. As will be clear to those of skill in the art after understanding the present disclosure, there are other curvatures or shapes of the vanes, including straight or linear shapes, which will result in the desired movement of coins toward a central opening 124. Vanes which are more highly inclined, curved or spiraled will, in general, result in higher radially-inward velocities, earlier in the disk rotation, and accordingly one aspect of the invention includes selecting the shape and position of the front surface vanes so as to control the radial velocity of the coins (for a given disk rotational rate) e.g. to maintain the desired throughput of coins while avoiding a radial velocity which is so high that coins may overshoot the central opening 124.

As seen in FIGS. 6A–6G, after a coin 512 enters the space 126 through the central opening 124 (to the extent space is available in the region 126), the coin will tend to move, under the influence of gravity, toward the bottom portion of the region 126 as depicted in FIG. 6B. In this position, as the disk 114 rotates (which is shown in FIGS. 6A–6G as a counterclockwise rotation, since the view of FIGS. 6A–6G is a rear or back view of the disk 114), eventually one of the rear surface vanes 152*a* will contact the coin 512 as shown in FIG. 6C. Further rotation of the disk will force the coin 512 along the inner surface of the rim 214 to successively higher positions as depicted in FIGS. 6A–6G. As seen in FIGS. 6A–6G, the rear surface vanes 152 are configured to avoid a radially inward force on the coin 512, i.e. so that the coin is continually urged toward the rim 214. For example, as seen in FIG. 6F, the vane 152*a* is configured such that, even when the coin is positioned above the axis of rotation 134, the vane 152*a,* in the region 612 contacted by the coin 512 still has a substantially downward slope and, as a consequence, the tendency of the coin to move or roll "downhill" along the vane 152*a* means the coin 512 will have a net radially outward component. Because of the continued radially outward force on the coin, as the coin 512 reaches the exit opening 212 formed in the rim 214 it will tend to pass through the opening 212, i.e. in a radially outward direction e.g. for guidance on an outward path by e.g. guidance edge 614. As the coin 512 moves through the opening 212, it will contact successively more radially outward portions of the vane 152*a*. In the embodiment of FIGS. 6A–6F, the radially outermost portions of the vane 152*a* are more highly curved so as to maintain and, if desired, increase the radially outward force on the coin as it reaches the opening 212 (despite the changing angle of the vanes 152 as the vanes 152 are carried around by the rotating disk 114).

Preferably, the increasingly-curved radially-outward extreme of the vane 152*a,* as compared with the radially inward portion 153 of the vane 152*a* assists in assuring that only a single coin exits the opening 212 as the vane 152*a* rotates past the opening 212. For example, as depicted in FIGS. 6F and 6G, if the vane 152*a* also carries a second coin 616, the radially inward portion 153 of the vane 152*a* is shaped such that, by the time the disk 114 has rotated to the position depicted in FIG. 6G, while the first coin 512 passes through the opening 212, the radially inward portion 153 of the vane 152*a* on which the second coin 616 resides will have a radially inward and downward slope 618 tending to urge the coin 616 radially inward and away from the opening 212. In this fashion, coins are output through the opening 212 in a fashion such that not only are they singulated (in single file and in a known orientation, namely substantially parallel to the back plane 112) but are substantially spaced-apart so that the period of time between output through opening 212 of successive coins is equal to the time required for the disk 114 to rotate between a passage of a vane past the opening 212 and the passage of the next successive vane past the opening 212. In some situations, coins which are output relatively closely together in time can be difficult to control in the sense that it may be difficult to, when desired, output to the user the first such coin without outputting the second such coin, possibly resulting in overpayment of coins to the user. By avoiding outputting more than one coin for each vane passage past the opening 212, the coins will have at least a minimum spacing (in time) between successive coins, decreasing the likelihood of overpayment of coins to users.

Preferably, the central opening 124 has a size and shape required to accommodate the largest anticipated coin diameter and the thickness 138 of the space 126 between the backplate 112 and the disk 114 can preferably accommodate the thickest anticipated coin. The range of diameters to be accommodated by the device can relate to other features of the apparatus as well. For example, if it is desired to provide the possibility of holding two or more coins on an interior vane (e.g. as depicted in FIGS. 6F and 6G) such as may be desirable in order to reduce or avoid the incidence of empty vanes, which can result in a reduction in coin throughput, then the diameter of the disk must be at least large enough to accommodate a vane which is long enough to hold two or more coins, and, accordingly, relatively larger-diameter coins may require an increase in the diameter of the disk and/or the length of the vanes. Also, the length of the highly-curved terminal portion 155 (FIG. 6D) of the interior vanes may be affected by the diameter of the coins to be accommodated or processed. However, it is, in general, preferred to provide a device having a size permitting it to be accommodated in a volume similar to the volume occupied by previous coin singulators in existing gaming devices e.g. so as to facilitate retrofitting singulators as described herein into existing gaming devices. For coins which are more massive and/or have a larger diameter, it may be desirable to design or adjust the degree of curvature of the front vanes 142 so the coins will have the desired radially inward velocity upon approaching the central opening, as described above. In general, as the diameter of the disk 114 is decreased, or the speed of rotation of the disk is increased, the time needed or available for moving the coin to the central opening will decrease, which may require a change in front vane configuration to achieve the desired radially-inward velocity as described above.

In light of the above description, a number of advantages of the present invention can be seen. The present invention provides for gaming device output coin singulation using relatively few components and/or moving parts and thus providing a system in which relatively few parts need to be maintained in inventory in order to achieve desired fabrication, repair or maintenance. Reduction in inventory is also promoted by the design being able to accommodate a relatively wide range of coin sizes. In one embodiment, a single design, generally as depicted in FIGS. 1–4 can accommodate substantially all coins and tokens having a diameter in the range between about 0.7 inches and about 2 inches. Preferably, in this embodiment, different coin thicknesses or thickness ranges can be accommodated by the use of spacers or similar devices for changing the thickness 138 of the space 126. In another embodiment, substantially all coins in the size range between about 0.7 inches and about 2 inches can be accommodated using three configurations:

a configuration for accommodating coins in the size range of about 0.7 inches to about 1.2 inches, a second configuration for accommodating coins in the size range between about 1.2 inches and about 1.6 inches, and a third configuration for accommodating coins in a size range between about 1.6 inches and about 2 inches in diameter. The principal difference among these three configurations is in the size of the central opening, (being sized slightly larger than the upper end of the coin diameter ranges noted). There may be differences in vane configuration or disk size to accommodate different diameter ranges as described above. Differences in coin thickness are preferably accommodated using spacers to adjust the thickness 138 of the space 126. Preferably, even though, as the thickness 138 is increased through the use of spacers, the rear surface vanes will be positioned farther from the backplate 112, the vanes preferably project sufficiently far into the space 126 to contact edges of coins contained therein when the coins are in face-to-face contact with the backplate 112 (as will typically be the case owing to the inclination 118 of the backplate) and thus will continue to achieve the coin movement described above. Because of the relatively smooth and curved surfaces which contact the coins, i.e. the substantial absence of sharp edges or corners, and the substantial absence of "pinch-points" along coin paths, the present invention assists in substantially reducing or eliminating jamming or other malfunctions of the coin singulator. Because the present invention can maintain coins within the space 126 registered against the rim 214 for a substantial portion of the rim circumference, it is possible to position the exit opening 212 at many different locations.

Figure 2:
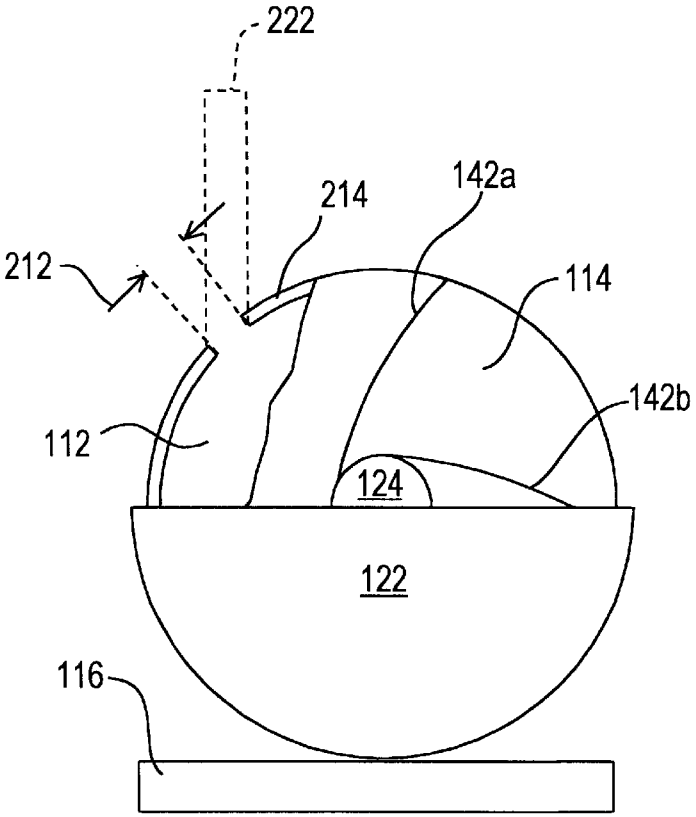
FIG. 2 is a front view of the singulator of FIG. 1, with the disk partially broken away.

Although a particular configuration has been described and depicted, it is also possible to construct the device in other configurations including a mirror image configuration e.g. so that the disk rotates in the counterclockwise direction (in the view of FIG. 5) and, preferably, to then position the exit opening on the right rather than the left side (in the view of FIG. 5), e.g. as may be needed to accommodate the location of an escalator 222 or other conveyor (the location being shown, in FIG. 2, in phantom lines). Because of the rotation of the disk, coins which are output can be provided with a velocity which has not only a radially outward component, but, if desired, a certain amount of upward or downward component. For example, it may be useful to configure the device such that output coins are provided with an upward velocity component to assist in moving coins onto or through an escalator, elevator or other component.

A number of variations and modifications of the invention can also be used. Although a device with four front and four rear vanes has been depicted, it is possible to provide a device with more or fewer vanes on either surface. For example, by increasing the number of vanes, the rate of throughput or rate of payout, for a given disk rotation rate, will increase. In one embodiment, it is preferred to position adjacent back surface vanes sufficiently close together to reduce or avoid the incidence of coins riding on top of "an edge-to-edge contact" with coins which are contacting a vane. The device can be provided with vanes which have a height or thickness greater or less than that depicted. If desired, a cover plate 172 (FIG. 1) can be positioned aligned with and spaced from the center hole e.g. to allow only coins that are oriented flat to the disk to enter the center hole. Such a cover plate 172 may also be useful in configurations where it is desired to maintain a relatively high level of coins within the bowl 122, such as a level higher than the central opening. If desired, geometry can be added, configured to push shingled coins back out the central opening and/or to keep unselected coins in the "pocket" (adjacent the rim 214) so that such coin will be carried substantially around the circumference of the rim and will pass through or by the opening 212 upon the next rotation of the disk. In this context unselected coins may be coins which do not exit the opening 212, e.g. because payout has been completed and thus discontinued. Although the edge of the central opening 124 has been depicted as substantially cylindrical in shape, the edge can be provided with a slope or chamfer e.g. to assist coins in moving toward the back surface. In one embodiment, the central opening is smaller than, or at least different from, twice the diameter of the coin being processed so as to avoid two coins jamming in the central opening.

The present invention, in various embodiments, includes components, methods, processes, systems and/or apparatus substantially as depicted and described herein, including various embodiments, subcombinations, and subsets thereof. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangable and/or equivalent structures, functions, ranges or steps are disclosed herein, and without intending to publicly dedicate any patentable subject matter.

What is claimed is:

1. Apparatus for singulating a mass of randomly oriented coins of a first coin diameter and a first coin thickness, for output as prizes from a gaming terminal, comprising:

a base;

a disk having an outer surface, a back surface and a central opening, said disk being rotatable about an axis passing through said central opening said axis being perpendicular to a plane which passes through at least a portion of said disk, said disk having a first plurality of vanes wherein rotation of said disk conveys at least some of said coins toward said central opening;

a substantially planar plate substantially parallel to said disk and spaced from said back surface of said disk by a distance less than about twice said first coin thickness;

a sidewall covering at least the majority of the circumferential extent between the edge of said disk and said plate, and defining a coin exit opening sized to accommodate exit of said coins; and a second plurality of vanes, rotatable about said axis wherein rotation of said second plurality of vanes conveys at least some coins, positioned between said disk and said plate, toward said exit opening.

2. Apparatus as claimed in claim 1 wherein said second plurality of vanes is formed integrally with said disk, wherein both said first set of vanes and said second set of vanes rotates with said disk.

3. Apparatus as claimed in claim 1 wherein at least one of said first plurality of vanes is curved with respect to radii of said disk, to define a generally spiral-shape.

4. Apparatus as claimed in claim 1 wherein at least one of said second plurality of vanes is curved with respect to radii of said disk.

5. Apparatus as claimed in claim 1 wherein said plate is at an angle with respect to vertical wherein coins are urged toward contact with said plate.

6. Apparatus as claimed in claim 1 wherein said outer surface of said disk tapers radially toward said central opening.

7. Apparatus as claimed in claim 1 wherein at least a portion of said outer surface of said disk tapers in a circumferential direction.

8. Apparatus as claimed in claim 1 wherein at least a portion of a first chord through said disk extending between at least first and second of said vanes defines a smooth contour which is non-parallel to said plane.

9. Apparatus for singulating a mass of randomly oriented coins of a first coin diameter and a first coin thickness, for output as prizes from a gaming terminal, comprising:

a base;

a first rotatable coin-moving means having an outer surface, a back surface and a central opening, said first means being rotatable about an axis passing through said central opening said axis being perpendicular to a plane which passes through at least a portion of said first means, said first means having a first plurality of vane means on said outer surface of said first means for conveying at least some of said coins toward said central opening as said first means rotates a substantially planar plate substantially parallel to said first means and spaced from said back surface of said first means by a distance less than about twice said first coin thickness;

wall means for covering at least the majority of the circumferential extent between the edge of said first means and said plate, and defining a coin exit opening sized to accommodate exit of said coins; and a second plurality of rotatable vane means on said back surface of said first means for conveying at least some coins, positioned between said first means and said plate, toward said exit opening as said second plurality of vane means rotates, wherein both said first plurality of vane means and said second plurality of vane means rotate with said first means.

10. Apparatus as claimed in claim 9 wherein said second plurality of vane means is formed integrally with said first means.

11. Apparatus as claimed in claim 9, wherein at least one of said first plurality of vane means is curved with respect to radii of said first means, to define a generally spiral-shape.

12. Apparatus as claimed in claim 9 wherein at least one of said second plurality of vane means is curved with respect to radii of said first means.

13. Apparatus as claimed in claim 9 further comprising means for urging coins toward contact with said plate.

14. Apparatus as claimed in claim 9 wherein at least a portion of a first chord through said first means extending between at least first and second of said first plurality of vane means defines a smooth contour which is non-parallel to said plane.

15. Apparatus as claimed in claim 9 further comprising means for adjusting the spacing between said first means and said plate.

16. Apparatus as claimed in claim 9 further comprising means for avoiding output of more than one coin as each vane means passes said exit opening.

17. A method for singulating a mass of randomly oriented coins of a first coin diameter and a first coin thickness, for output as prizes from a gaming terminal, comprising:

providing a base;

rotatably coupling a disk to said base, said disk having an outer surface, a back surface and a central opening, said disk being rotatable about an axis passing through said central opening said axis being perpendicular to a plane which passes through at least a portion of said disk, said disk having a first plurality of vanes on said outer surface, wherein rotation of said disk conveys at least some of said coins toward said central opening, said disk further having a second plurality of vanes on said rear surface to position said second plurality of vanes between said disk and said plate wherein rotation of said second plurality of vanes conveys at least some coins, positioned, toward an exit opening;

positioning a substantially planar plate substantially parallel to said disk and spaced from said back surface of said disk by a distance less than about twice said first coin thickness;

providing a sidewall covering at least the majority of the circumferential extent between the edge of said disk and said plate, said sidewall defining said exit opening sized to accommodate exit of said coins; and rotating said disk about said axis.

18. A method as claimed in claim 17 wherein at least one of said first plurality of vanes is curved with respect to radii of said disk, to define a generally spiral-shape.

19. A method as claimed in claim 17 wherein at least one of said second plurality of vanes is curved with respect to radii of said disk.

20. A method as claimed in claim 17 further comprising mounting said plate at an angle with respect to vertical wherein coins are urged toward contact with said plate.

* * * * *